United States Patent [19]

Lemaster

[11] Patent Number: 4,718,344

[45] Date of Patent: Jan. 12, 1988

[54] APPARATUS AND METHOD FOR OSCILLATING THE FORM ROLLERS IN A PRINTING PRESS

[76] Inventor: Milton R. Lemaster, 16528 Westgrove, Dallas, Tex. 75248

[21] Appl. No.: 858,944

[22] Filed: May 2, 1986

[51] Int. Cl.[4] ..... B41F 1/46

[52] U.S. Cl. ..... 101/426; 101/348; 101/DIG. 14

[58] Field of Search ..... 101/348–349, 101/350, 351, 352, DIG. 14, 147–148, 426, 207–208, 210, 212, 216, 277, 132.5, 330, 331, 363, 364, 367; 118/46, 113, 120

[56] References Cited

U.S. PATENT DOCUMENTS

| | | | |
|---|---|---|---|
| 400,221 | 3/1889 | King | 101/DIG. 14 |
| 2,033,950 | 3/1936 | Morse | 101/DIG. 14 |
| 2,645,997 | 7/1953 | Grede | 101/348 |
| 3,983,812 | 10/1976 | Schramn | 101/349 |
| 4,493,257 | 1/1985 | Kubert et al. | 101/349 |
| 4,546,701 | 10/1985 | Junghans | 101/DIG. 14 |

*Primary Examiner*—E. H. Eickholt
*Attorney, Agent, or Firm*—W. Kirk McCord

[57] ABSTRACT

An apparatus and method for oscillating the form rollers in a lithographic printing press to apply a smooth, relatively uniform coating of ink to the ink-receptive areas of a lithographic printing plate. The apparatus is comprised of a shaft rotatable about its own axis and a roller concentrically disposed on the shaft. The roller is preferably comprised of a hollow cylindrical metal core surrounded by a rubber covering. First and second bronze bushings are partially inserted into the hollow core at respective opposite ends of the roller. The shaft has first and second shaft keys for mating with complementary first and second keyways formed in the respective first and second bushings to allow the bushings to engage the shaft for common rotation while allowing the roller and bushings to slide axially with respect to the shaft. First and second collar members are disposed at respective predetermined locations on the shaft for limiting the axial movement of the roller on the shaft between selected limits. In the preferred embodiment the apparatus is installed as a form roller device in a lithographic printing press. The form roller is rotated and moved axially substantially in unison with the rotation and axial movement of the corresponding vibrating roller.

14 Claims, 3 Drawing Figures

APPARATUS AND METHOD FOR OSCILLATING THE FORM ROLLERS IN A PRINTING PRESS

FIELD OF THE INVENTION

The present invention relates generally to lithographic printing press systems and in particular to a system and method for oscillating the ink form rollers along with the corresponding vibrating rollers.

BACKGROUND OF THE INVENTION

An inker for a lithographic printing press includes an ink fountain having a rotatable fountain roller for picking up the ink from the fountain. The ink is transferred from the fountain roller by a plurality of ink distribution rollers, which in turn transmit the ink to a plurality of form rollers for applying the ink to the plate cylinder. The ink distribution rollers include vibrating rollers, which are in contact with respective ones of the form rollers and which oscillate axially as they rotate.

"Ghosting" is a common problem encountered in such lithographic printing presses having an inker as described above. The ghosting problem results from ink starvation on certain areas of the plate cylinder. For example, when it is desired to print images in the same color and shade where the image is printed by at least two portions on the plate cylinder, one portion of which extends angularly relative to the other portion, one portion of the image will not be the same shade as the other portion. Thus, a distinct change in color occurs in the image, which is noticeable to the human eye. Typically, the portion of the image which is printed by the ink-receptive plate area of the greatest circumferential extent around the plate cylinder (the circumferential section of the plate cylinder having the greatest percentage of ink-receptive area) is lighter in shade than the other portion of the image and the change in shade occurs along a line.

DESCRIPTION OF THE PRIOR ART

Prior attempts to increase the amount of ink which is applied to the ink-receptive area of the plate cylinder which prints a portion of the image having the greatest circumferential extent around the plate cylinder have failed to solve the starvation problem. Such attempts have generally involved adjustments of the inker, changing the length and frequency of oscillation of the vibrating rollers and, cocking the images, "double bumping" and the like.

Another technique, as described in U.S. Pat. No. 4,493,257, involves oscillation of one of the form rollers. The particular form roller which is oscillated is the last of the form rollers to be encountered by an area of the plate as it rotates. The oscillating form roller moves only about one-third ($\frac{1}{3}$) of the total axial movement of the corresponding vibrating roller.

While the technique of oscillating one of the form rollers described above is somewhat effective in solving the "ghosting" problem, ghosting will still occur on those areas of the image which are printed when the form roller is not oscillating. Furthermore, such printing presses often include three or four form rollers. Therefore, ghosting will continue to occur on those areas of the image imprinted by the non-oscillating form rollers.

OBJECTS OF THE INVENTION

It is, therefore, the principal object of the present invention to provide an improved system and method for oscillating the form rollers in a lithographic printing press.

Another object of the invention is to provide a system and method for substantially eliminating the problem of ghosting in a lithographic printing press.

Still another object of the invention is to provide a system and method for providing a smooth, relatively uniform coating of ink on the plate cylinder in a lithographic printing press.

Yet another object of the invention is to improve the quality of the image printed by a lithographic printing press.

SUMMARY OF THE INVENTION

These and other objects are accomplished in accordance with the present invention in which an apparatus for applying a relatively uniform coating of ink to the ink-receptive area of a lithographic printing plate is comprised of a shaft rotatable about its own axis and roller means concentrically disposed on the shaft and being rotatable along with the shaft. The roller means is moveable along the axis of the shaft and has a substantially cylindrical outer surface for contacting the printing plate and applying a relatively uniform coating of ink to the ink-receptive areas thereof when the roller means is rotated about the axis of the shaft and is moved in an oscillating manner along the axis of the shaft.

In one embodiment the apparatus further includes first and second collar members disposed at respective first and second predetermined locations on the shaft for limiting the axial movement of the roller means between selected limits. In yet another embodiment the apparatus further includes first and second bearing members disposed at respective opposite ends of the shaft for journally supporting the shaft and roller means when the apparatus is installed in a lithographic printing press.

In still another embodiment the roller means is comprised of an elongated cylindrical roller having a central opening extending between opposite ends of the roller and first and second bushing members partially inserted into the opening at the respective opposite ends of the roller. The first and second bushing members also have respective central openings for receiving the shaft therein to mount the roller on the shaft. The shaft has first and second elongated shaft keys disposed thereon adjacent to the respective first and second bushings. The first and second bushings have respective first and second elongated keyways for receiving the respective first and second shaft keys to engage the shaft for common rotation while allowing the roller and bushings to slide axially with respect to the shaft.

In the preferred embodiment the apparatus is comprised of form roller means for being installed in a lithographic printing press having a series of ink distribution rollers for transferring ink from an ink source to the printing plate. The ink distribution rollers include at least one vibrating roller and at least one form roller disposed between and in contact with the vibrating roller and the printing plate. The printing press includes a device for rotating the vibrating roller and for moving it axially to transfer ink to the form roller. The form roller is allowed to rotate and move axially along with the vibrating roller so that the form roller applies a relatively uniform coating of ink to the ink-receptive areas of the printing plate.

The form roller is preferably moved substantially the same distance axially as the vibrating roller. In a lithographic printing press typically having a plurality of form rollers, all of the form rollers are rotatable to transfer ink to the printing plate and at least two of the form rollers are moveable axially along with the corresponding vibrating roller for optimum transfer of ink to the printing plate.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
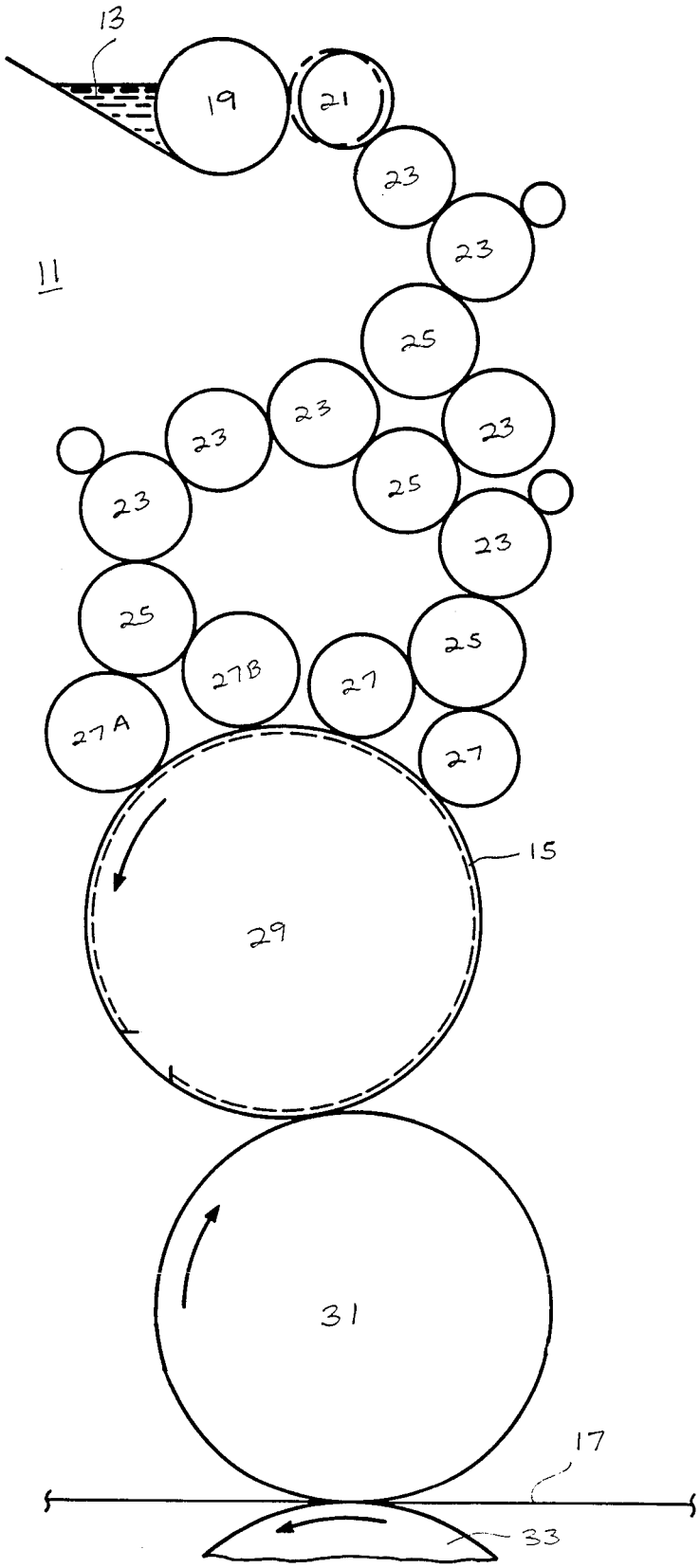
FIG. 1 is a schematic illustrating the ink distribution roller system in a lithographic printing press.

Referring to FIG. 1, an ink distribution system 11 for transferring printing ink from an ink fountain 13 to a printing plate 15 for printing an image on sheet 17. Ink distribution system 11 includes an ink fountain roller 19, a ductor roller 21, six (6) distributor rollers 23, four (4) vibrating rollers 25 and four (4) form rollers 27.

As readily seen in FIG. 1, each of the four form rollers 27 is in contact with printing plate 15 at any given time at respective discrete positions along the circumference of printing plate 15. Printing plate 15 is disposed on a cylindrical plate cylinder 29 and is also in contact with first blanket cylinder 31, which transfers the image to be imprinted to sheet 17 as sheet 17 passes between blanket cylinder 31 and back cylinder 33.

One skilled in the art will recognize that printing plate 15 includes ink-receptive areas and ink-rejecting areas. The ink-rejecting areas of printing plate 15 are covered with a dampening solution, such as water, applied by a series of water rollers, which are not illustrated in FIG. 1 because they form no part of the present invention. The ink-receptive areas of plate 15 receive ink from the four (4) form rollers 27 as plate 15 is rotated by plate cylinder 29 in the direction indicated by the arrow in FIG. 1. The ink is then applied to first blanket cylinder 31, which in turn prints the images on sheet 17. Sheet 17 is moved through the printing press in the direction of the horizontal arrow above sheet 17. In many instances plate 15 has adjacent circumferential sections which are ink-receptive and frequently such sections extend circumferentially and axially different distances around plate cylinder 29.

The present invention allows a smooth, uniform coating of ink to be applied to the various ink-receptive areas of plate 15 so that there is no sharp difference in the shade of the color which is printed in different portions of the image. In accordance with the present invention form rollers 27 are mounted for axial movement along with the axial movement of the corresponding vibrating rollers 25. The axial movement of form rollers 27 occurs as a result of the pressure engagement with the corresponding vibrating rollers 25 while the form rollers 27 are in ink-transmitting relationship with plate 15. The axial movement of form rollers 27 promotes the formation of a smooth film of ink on the ink-receptive areas of plate 15, thereby eliminating noticeable changes in color and intensity in the image imprinted on sheet 17.

Figure 2:
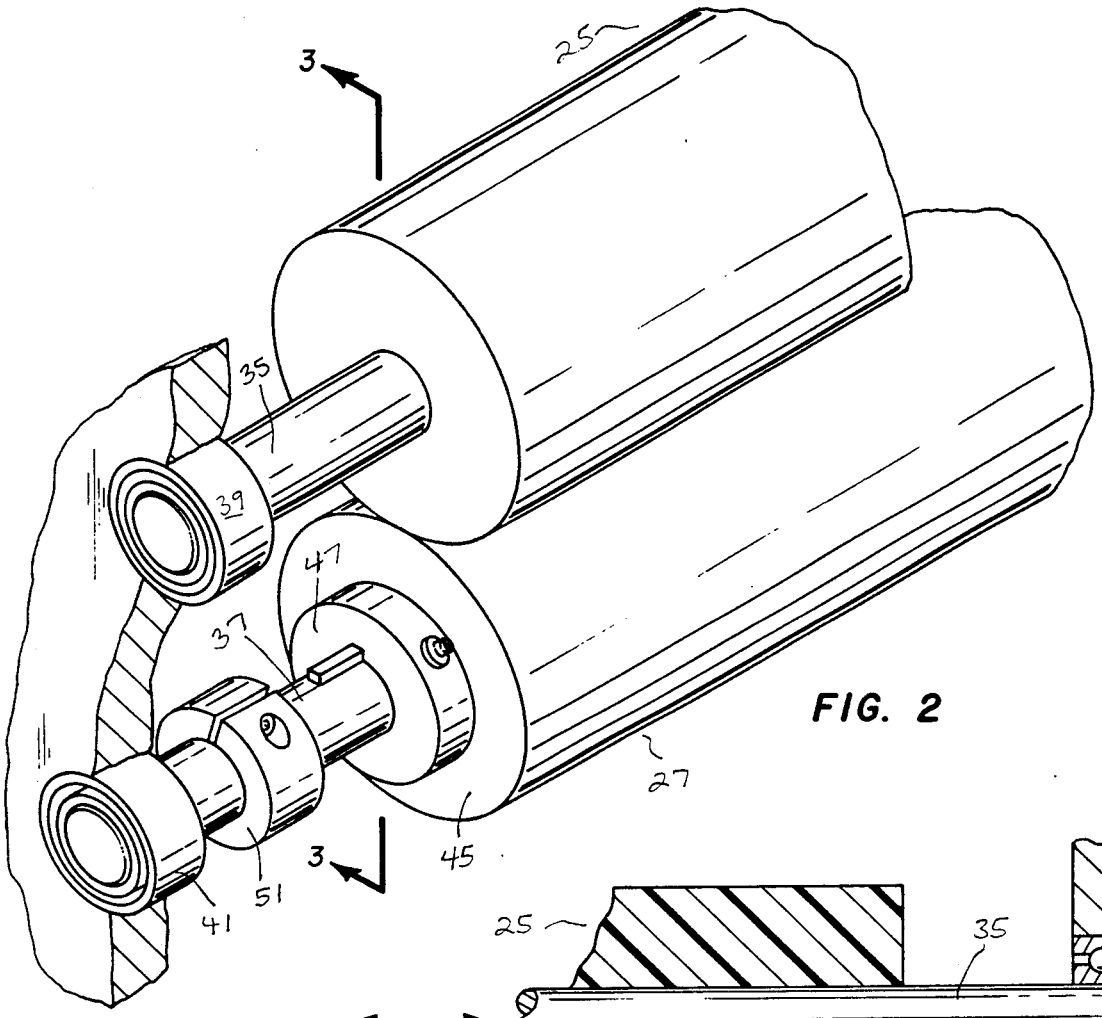
FIG. 2 is a perspective view of respective portions of the vibrating roller and form roller in a lithographic printing press according to the present invention.
Figure 3:
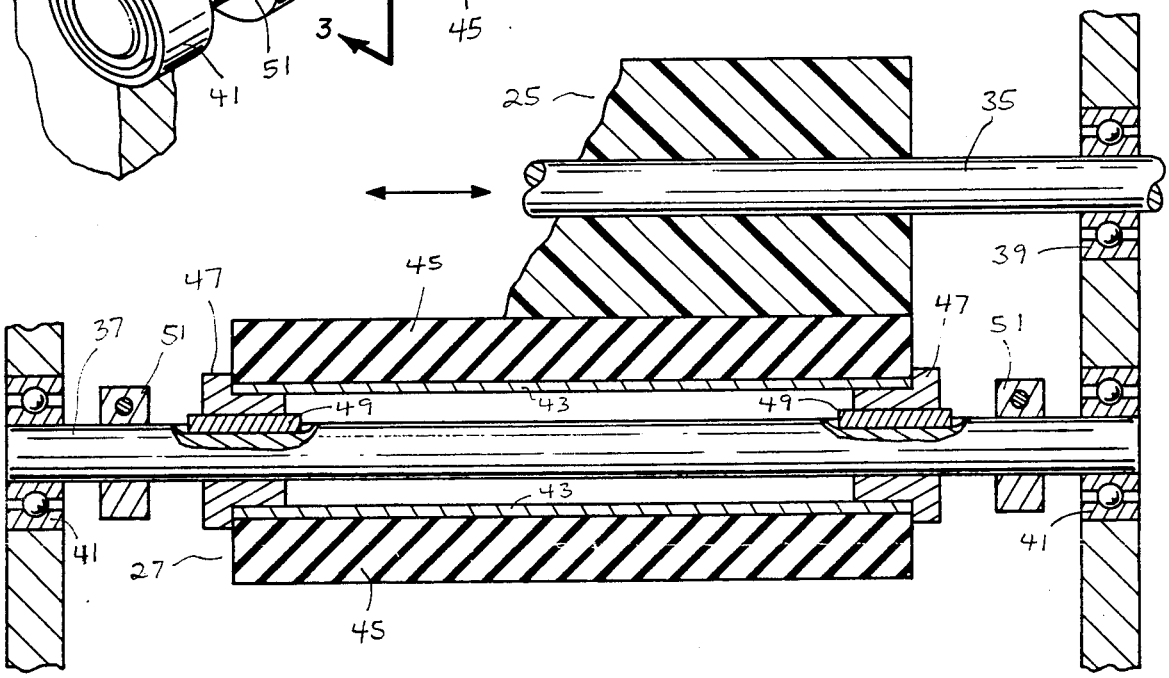
FIG. 3 is a sectional view of the vibrating roller and form roller, taken along the line 3—3 in FIG. 2.

Each vibrating roller 25 has a conventional drive system, which may include an electric drive motor and worm gear mechanism, associated therewith for moving the corresponding vibrating roller 25 back and forth in an axial direction. Such drive mechanisms are conventional and will not be described herein because they do not form a part of the present invention. Referring to FIGS. 2 and 3, each form roller 27 is in contact with a corresponding vibrating roller 25. Each form roller 27 is mounted so as to be rotatable and axially moveable substantially in unison with the corresponding vibrating roller 25. Thus, vibrating roller 25 acts as the drive roller and form roller 27 acts as the driven roller. Vibrating roller 25 is mounted in a fixed position on shaft 35 so that vibrating roller 25 rotates and moves axially together with shaft 35. Shaft 35 is rotated and moved in an oscillating manner along its axis by the conventional drive system discussed above, which in turn imparts rotational and axial motion to roller 25. Roller 25 is preferably comprised of a nylon or metal material.

Similarly, form roller 27 is mounted on shaft 37. Shafts 35 and 37 are journally supported at their respective opposite ends by bearings 39 and 41, respectively. Form roller 27 is preferably comprised of a hollow metal cylinder 43 surrounded by a cylindrical rubber covering 45. First and second bronze bushings 47 are partially inserted into metal cylinder 43 at respective opposite ends thereof and are in fixed engagement with form roller 27 so as to rotate and be axially moveable along therewith. Shaft 37 includes first and second shaft keys 49 at respective predetermined positions thereon for mating with complementary shaft keyways formed in bushings 47, thereby engaging form roller 27 for common rotation along with shaft 37, while allowing form roller 27 and bushings 47 to slide axially with respect to shaft 37. Shaft keys 49 are substantially received within the corresponding bushings 47 and within metal cylinder 43, as best seen in FIG. 3. The length of each shaft key 49 is at least equal to the total axial distance which form roller 27 is moveable from the extreme left to the extreme right position as viewed in FIG. 2. In FIG. 2, form roller 27 is shown in the extreme right position. First and second collars 51 are disposed at respective predetermined positions on shaft 37 to constrain the axial movement of form roller 27 within selected limits determined by the respective positions of first and second collars 51. Thus, the axial movement of form roller 27 may be controlled within desired limits, typically form 0 to ¾ inch in either direction. In the preferred embodiment, form roller 27 is allowed to move axially in each direction the same amount as the corresponding vibrating roller 25 to enhance the smooth transfer of ink to the ink-receptive areas of printing plate 15. Otherwise, if form roller 27 is allowed to remain stationary for a substantial length of time, ghosting will occur in the image printed by the plate areas in contact with form roller 27 while it is in a stationary position.

It has been determined that optimum print quality is achieved when at least two (2) of form rollers 27 are allowed to oscillate back and forth in the manner described above. The pair of form rollers which it is most desirable to rotate are those designated as 27A and 27B, which are those form rollers which contact printing plate 15 last during each rotation of plate 15. One skilled in the art will readily appreciate that all of the form rollers 27 may be allowed to move axially along with the corresponding vibrating rollers 25 to further enhance the application of a smooth, relatively uniform coating of ink to printing plate 15.

The combination of the rotational and axial movement of form roller 27 with respect to printing plate 15 causes the rubber surface of form roller 27 to move in a substantially helical pattern with respect to plate 15. It has been determined that the helical movement of form roller 27 across plate 15 does not increase the wear on plate 15. The cylindrical metal core of the roller is protected from wear by the bronze bushings. The rubber covering and bronze bushings can be replaced as dictated by wear without having to replace the remainder of the roller assembly. The apparatus according to the present invention substantially eliminates the ghosting problem without the need for complex and expensive equipment.

Various embodiments of the invention have now been described in detail. Since changes in and modifications to the above-described preferred embodiment may be made without departing from the nature, spirit and scope of the invention, the invention is not to be limited to said details, except as set forth in the appended claims.

What is claimed is:

1. A method for applying ink to a printing plate in a lithographic printing press, said method comprising the steps of:

providing a series of ink distribution rollers for transferring ink from an ink source to the printing plate, said roller including at least one vibrating roller and at least one form roller disposed between said vibrating roller and said plate and being in contact with both said vibrating roller and said plate so that rotary and axial motion of said vibrating roller is substantially imparted to said form roller;

rotating said vibrating roller about its major axis and moving said vibrating roller in an oscillating manner along its major axis to transfer ink to said form roller; and allowing said form roller to rotate in response to the rotary motion imparted thereto by said vibrating roller and to move axially along with said vibrating roller in an oscillating manner substantially the same distance in either direction as said vibrating roller so that said form roller applies a relatively uniform coating of ink to said printing plate.

2. The method according to claim 1 further including the steps of:

mounting said form roller on an elongated shaft;

journally supporting the respective opposite ends of said shaft to allow said shaft to rotate about its own axis; and allowing said form roller to engage said shaft so that said form roller and said shaft rotate together while allowing said form roller to slide axially back and forth along said shaft.

3. The method according to claim 2 further including the step of placing first and second collar members at respective predetermined positions on said shaft for limiting the axial movement of said form roller along said shaft in either direction within selected limits.

4. An apparatus for applying a relatively uniform coating of ink to the ink-receptive areas of a lithographic printing plate, said apparatus comprising:

a shaft rotatable about its own axis;

an elongated cylindrical roller having a central opening extending between opposite ends of said roller, said roller being rotatable along with the shaft and being movable along the axis of the shaft, said roller having a substantially cylindrical outer surface for contacting said printing plate and applying a relatively uniform coating of ink to the ink-receptive areas of the printing plate when said roller is rotated about the axis of the shaft and is moved in an oscillating manner along the axis thereof;

first and second bushings at least partially inserted into said opening at the respective opposite ends thereof, said first and second bushings having respective openings for receiving the shaft therein to mount the roller on the shaft; and first and second substantially smooth elongated shaft keys disposed on said shaft adjacent to the respective first and second bushings so that said first and second shaft keys are substantially received within the central opening and the openings of the respective first and second bushings, said first and second bushings having respective first and second elongated keyways for receiving the respective first and second shaft keys to engage the shaft so that the roller and bushings rotate along with the shaft while allowing the roller and bushings to slide axially with respect to the shaft.

5. The apparatus according to claim 4 further including first and second collar members disposed at respective first and second predetermined locations on the shaft for limiting the axial movement of said roller between selected limits.

6. The apparatus according to claim 4 wherein said cylindrical roller is comprised of a hollow metal core with a rubber covering concentrically disposed thereon.

7. The apparatus according to claim 4 further including first and second bearing members disposed at respective opposite ends of said shaft for journally supporting said shaft and said roller when said apparatus is installed in a lithographic printing press.

8. The apparatus according to claim 4 wherein said roller is a form roller for being installed in a lithographic printing press.

9. A system for applying ink to a printing plate in a lithographic printing press having a series of ink distribution rollers for transferring ink from an ink source to the printing plate, said system comprising:

at least one vibrating roller which is rotatable about its major axis and is movable along its major axis;

at least one form roller disposed between said vibrating roller and said printing plate and being in contact with said vibrating roller and said printing plate, said at least one form roller being rotatable about its major axis and being movable along its major axis; and means for rotating said vibrating roller and moving said vibrating roller axially to transfer ink to said form roller, the rotary motion of said vibrating roller being imparted to said form roller to rotate said form roller and the axial movement of said vibrating roller being imparted to said form roller to move said form roller axially along with said vibrating roller substantially the same distance in either direction as said at least one vibrating roller.

10. The system according to claim 9 wherein said system includes a plurality of form rollers, each of said form rollers being in contact with a corresponding vibrating roller.

11. The system according to claim 10 wherein at least two of said form rollers are moveable axially along with the corresponding vibrating roller.

12. The system according to claim 11 wherein the form rollers which are moveable axially along with the corresponding vibrating roller are those form rollers which are the last to contact the printing plate as the plate rotates.

13. The system according to claim 9 wherein said at least one form roller is comprised of:

a shaft rotatable about its own axis;

an elongated cylindrical roller having a central opening extending between opposite ends of said roller and being rotatable along with the shaft and movable along the axis of the shaft;

first and second bushings at least partially inserted into said central opening at the respective opposite ends thereof, said first and second bushings having respective openings for receiving the shaft therein to mount the roller on the shaft; and first and second substantially smooth elongated shaft keys disposed on said shaft adjacent to the respective first and second bushings so that said first and second shaft keys are substantially received within the respective openings in said first and second bushings, said first and second bushings having respective first and second elongated keyways for receiving the respective first and second shaft keys to engage the shaft so that the roller and bushings rotate along with the shaft while allowing the roller and bushings to slide axially with respect to the shaft.

14. The system according to claim 13 wherein said cylindrical roller is comprised of a hollow metal core with a rubber covering concentrically disposed thereon.

* * * * *

UNITED STATES PATENT AND TRADEMARK OFFICE

CERTIFICATE

Patent No. 4,718,344 Patented: January 12, 1988

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Milton R. Lemaster and Norman H. Kemp.

Signed and Sealed this 14th Day of March 1989.

Jeffrey V. Nase
Supervisory Petitions Examiner
Office of the Deputy Assistant
Commissioner for Patents